United States Patent [19]

De La Cruz Cuevas

[11] 4,106,224

[45] Aug. 15, 1978

[54] CUTTING ASSEMBLY

[75] Inventor: Francisco De La Cruz Cuevas, Peoria, Ill.

[73] Assignee: Caterpillar Tractor Co., Peoria, Ill.

[21] Appl. No.: 778,203

[22] Filed: Mar. 16, 1977

[51] Int. Cl.[2] ..... E02F 5/02

[52] U.S. Cl. ..... 37/80 A; 37/DIG. 16; 83/806

[58] Field of Search ..... 37/80 R, 80 A, 190, 37/191 R, 191 A, 192 R, 192 A, DIG. 16; 83/788, 804–806; 198/313, 627, 819; 175/77, 89–90, 258–260, 263, 265–266, 273, 279–280; 172/100, 753, 91–93, 95, 542, 545, 550

[56] References Cited

U.S. PATENT DOCUMENTS

| | | | |
|---|---|---|---|
| 74,006 | 2/1868 | Runstetler et al. | 172/109 X |
| 558,683 | 4/1896 | Girouard | 37/DIG. 16 |
| 1,343,081 | 6/1920 | Hammen | 37/80 A |
| 1,850,363 | 2/1932 | Vaughn | 37/DIG. 16 |
| 2,223,608 | 12/1940 | George | 37/190 |
| 3,146,538 | 9/1964 | Uiselev et al. | 37/DIG. 16 |
| 3,286,377 | 11/1966 | Long | 37/DIG. 16 |
| 3,936,961 | 2/1976 | Gahler | 37/DIG. 16 |

*Primary Examiner*—E. H. Eickholt
*Attorney, Agent, or Firm*—John L. James

[57] ABSTRACT

A cutting assembly has first and second cutting elements. The cutting elements have outer end portions and extend generally laterally in opposed directions. The cutting elements are movable between a first position at which the end portions of the cutting elements are spaced a first preselected distance one from the other and a second position at which the end portions are spaced a different distance one from the other.

11 Claims, 5 Drawing Figures

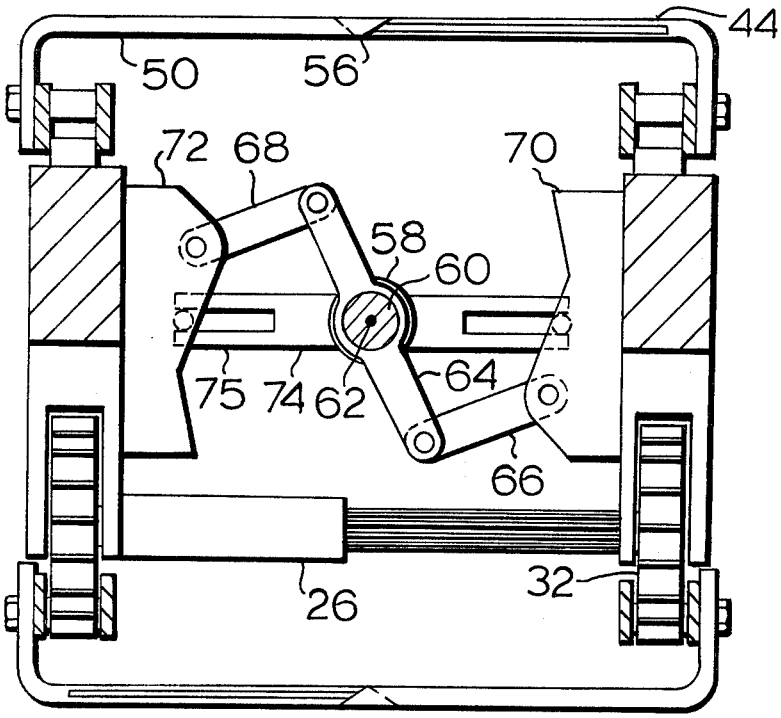
Fig-3-
Fig-4-
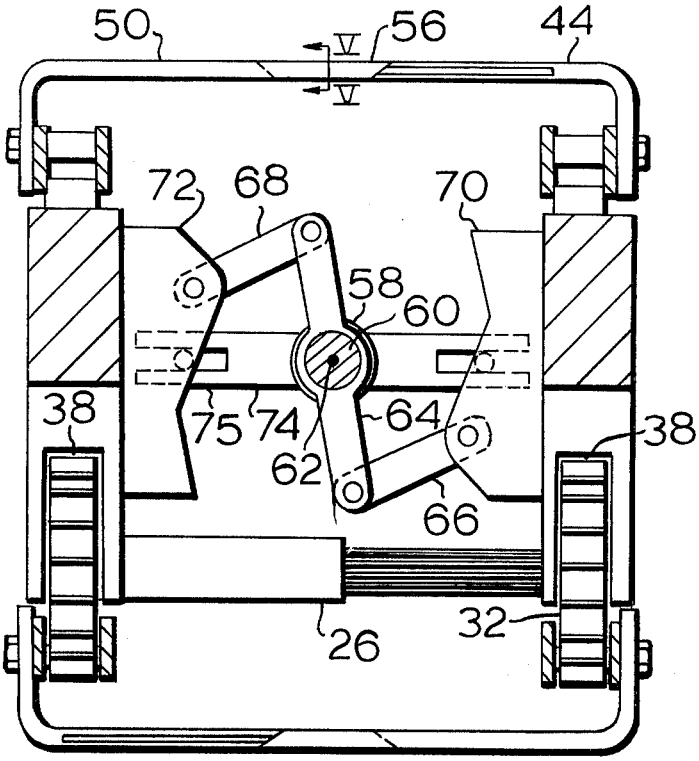
Fig-5-
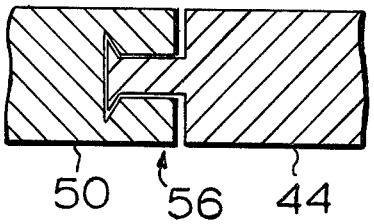

CUTTING ASSEMBLY

BACKGROUND OF THE INVENTION

A cutting assembly of an excavator, for example, is generally adapted to make a cut of a predetermined width. When it is desired to make a cut having a different width, the cutting elements are replaced with cutting elements of the desired width or a properly sized cutting assembly is used. Replacing cutting elements involves a great amount of time. The cutting elements are often heavy for one person to replace and are often awkwardly shaped and are time consuming to replace. It is impractical to replace cutting elements where many cuts of varying widths are desired and it is also impractical to use more than one cutting assembly. This suggests using cutting elements which produce a cut of maximum desired width. However, such cut may be wider than necessary at some points and thus more time consuming and expensive than a narrower cut.

The present invention is directed to overcoming one or more of the problems as set forth above.

According to the present invention, a cutting assembly has first and second cutting elements. The first cutting element has an outer end and extends generally laterally in one direction. The second cutting element extends generally laterally in an opposed direction and has an outer end which is laterally spaced a preselected distance from the outer end of the first cutting element. The cutting elements are movable between a first position at which the end portions are spaced a first preselected distance one from the other and a second position at which the end portions are spaced a different distance one from the other.

BRIEF DESCRIPTION OF THE DRAWINGS

FIG. 3 is a simplified cross sectional view of the cutting assembly taken along the line III—III of FIG. 2;

FIG. 4 is a simplified cross sectional view of the cutting assembly similar to FIG. 3; and FIG. 5 is a somewhat enlarged partial side view of a cutting element taken along the line V—V of FIG. 4.

DETAILED DESCRIPTION OF THE INVENTION

Figure 1:
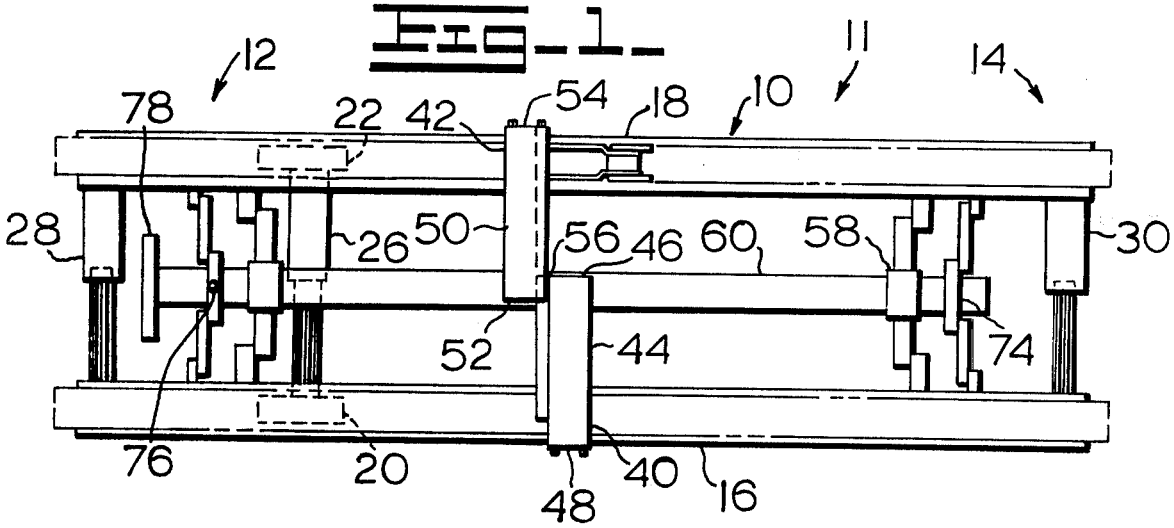
FIG. 1 is a partial plan view of a cutting assembly.

Referring to FIG. 1, a cutting assembly 10 of an excavator 11, for example, has first and second end portions 12 and 14 and first and second support elements 16, 18 with openings 20, 22 respectively and support brackets 24. An axle 26 is positioned in the openings 20, 22 which are preferably aligned and located on the first end portion 12 of the assembly 10. Bearings 27 are preferably positioned in the openings 20, 22 about the axle 26. Adjustable spacers, such as splined spacers 28, 30 are positioned between the first and second support elements 16, 18 with one or more being positioned on either side of the axle 26. The axle 26 is preferably splined in a manner similar to the spacers 28, 30, but can be of a single piece construction which is slidably disposed in the openings 20, 22.

Figure 2:
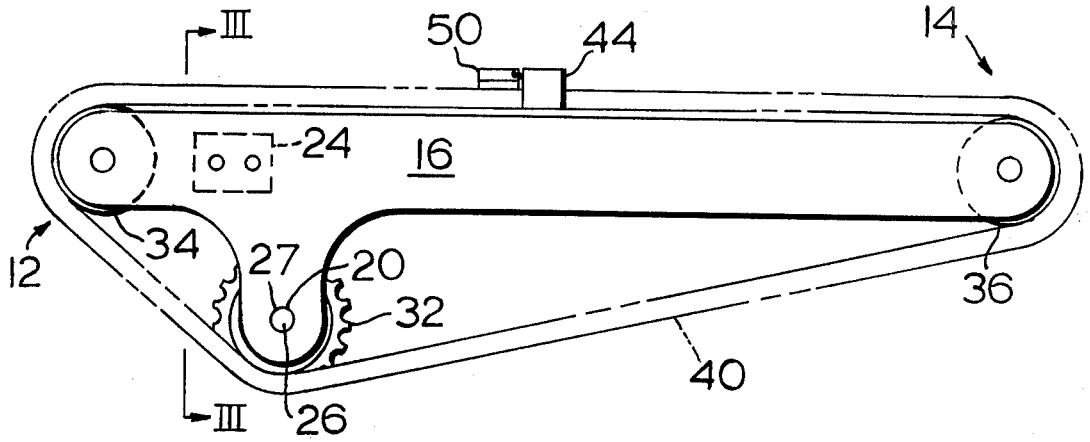
FIG. 2 is a diagrammatic side view of the cutting assembly.

Referring to FIG. 2, the first support element 16 preferably has a sprocket drive wheel 32 on the axle 26 and idler wheels 34, 36 rotatably mounted on either end of the support element 16. The drive wheel 32 is preferably offset from the idler wheels 34, 36 and forms a generally triangular configuration therewith. The drive wheel 32 and idler wheels 34, 36 are preferably positioned in recesses 38 of the first support element 16. Either idler wheel 34, 36 can also be used as a drive wheel. The first support element 16 can be in the form of a modified cross which has another wheel (not shown) generally aligned with drive wheel 32. The support element 16 may be of channular construction of any suitable construction. The second support element 18 is constructed and equipped in a manner similar to the first support element 16.

First and second endless chains 40, 42 are entrained about the respective first and second support elements 16, 18. The first chain 40 is also entrained about the first drive wheel 32 and idler wheels 34, 36. The first chain 40 is composed of a series of interconnected first cutting elements 44 which have inner and outer ends 46, 48 and which are preferably removably mounted (FIG. 1).

The second endless chain 42 is similarly entrained about the second support element 18. The second chain 42 is composed of a series of interconnected second cutting elements 50 which have inner and outer ends 52, 54 and which are preferably removably mounted. The inner ends 46 of the first cutting elements 44 preferably overlap the inner ends 52 of the second cutting elements 50. The inner end 46 of one of the first cutting elements 44 is slidably engaged with the inner end 52 of one of the second cutting elements 50, preferably by a tongue and groove joint 56, or the like (FIG. 5). The width of the cut is determined by the distance between the outer ends 48, 54 of the engaged cutting elements 44, 50. The removably mounted cutting elements are constructed of a preselected material appropriate for the particular material to be cut, such as steel, for cutting earth or the like.

Referring to FIG. 1, a linkage mechanism 58 is connected preferably to the first and second support elements 16, 18 but can be connected to the chains 40, 42. There is preferably a plurality of such linkage mechanisms 58 (FIG. 1) interconnected by a shaft 60. The mechanisms 58 are preferably of a size and construction sufficient for fitting between the support elements 16, 18 without protrusions extending therefrom.

Referring to FIGS. 3 and 4, the linkage mechanism 58 is pivotally movable about a centrally positioned axis 62. The linkage mechanism 58 includes a lever 64 fixedly attached to the shaft 60 and first and second links 66, 68 pivotally connected to the lever 64. The mechanism 58 also includes first and second mounting brackets 70, 72 fixedly attached to the respective first and second support elements 16, 18 and pivotally connected to the respective first and second links 66, 68. A shaft support 74 has slotted end portions 75 which slidably engage the mounting brackets 70, 72, and is preferably releasably connected to the shaft 60 by a set screw 76, or the like. A set screw 76, for example, locks the shaft 60 in position when the desired width is selected. The shaft 60 is rotatable in the shaft support 74 and moves generally horizontally relative to the support elements 16, 18, but the shaft support 74 restricts generally vertical movement of the shaft 60. The shaft support 74 and linkage mechanism 58 can form a single mechanism. The shaft 60 has a coupler 78 for rotating the shaft 60 which is preferably rotated by using a source of power, such as motor or the like, connected to the coupler 78 but which can be rotated manually.

In the operation of the cutting assembly 10, the cutting assembly is suitably mounted on a vehicle, such as a tractor or the like. The cutting assembly can also be equipped with a support device such as a handle (not shown) connected about the support brackets 24. The axle 26 is preferably driven by a power source such as a motor, or the like (not shown). The axle 26 preferably drives both drive wheels 32 which are connected to the axle 26 and causes the first and second chains 40, 42 (FIGS. 1 and 2) to rotate. The first and second cutting elements 44, 50 rotate about the second end portion 14 of the cutting assembly 10 and cut material. The width of the cut is preferably adjusted by loosening the set screw and turning the coupler 78 in a counterclockwise direction for a wide cut (FIG. 3) or by turning the coupler 78 in a clockwise direction for a narrower cut (FIG. 4).

The linkage mechanism 58 moves the cutting elements 44, 50 between a first position at which the cutting width is maximum (FIG. 3) and a second position at which the cutting width is minimum (FIG. 4). The splined spacers 28, 30 and splined axle 26 adjust with the cutting width.

Other aspects, objects, and advantages of the present invention will become apparent from a study of the specification, drawings, and appended claims.

The embodiments of the invention in which an exclusive property or privilege is claimed are defined as follows:

1. A cutting assembly comprising:

a support element;

a first cutting element having an outer end and extending generally laterally in one direction and being generally movable about the support element;

a second cutting element having an outer end and extending generally laterally in an opposed direction and being generally movable about the support element, said outer end being laterally spaced a preselected distance from the outer end of said first element, said first and second elements overlapping one another and being movable between a first position at which the distance between the outer ends of said elements is maximum and a second position at which the distance between said outer ends is minimum; and means for releasably connecting said cutting elements, for controlled movement of the cutting elements generally perpendicular to said support element to a preselected position and maintaining the preselected position for making a single cut of substantially uniform width.

2. An apparatus, as set forth in claim 1, wherein the connecting means comprises a linkage mechanism movably connected between said first and second elements.

3. An apparatus, as set forth in claim 2, wherein said linkage mechanism is pivotally movable about a centrally positioned axis.

4. An apparatus, as set forth in claim 3, including means for rotating said linkage mechanism.

5. An apparatus as set forth in claim 4, wherein said rotating means includes a shaft fixedly attached to said linkage mechanism.

6. An apparatus, as set forth in claim 5, including a shaft support positioned about said shaft.

7. An apparatus, as set forth in claim 3 including locking means for fixing said linkage mechanism in a preselected position.

8. An apparatus, as set forth in claim 1, including a plurality of first and second cutting elements respectively connected to one another and forming first and second chains.

9. An apparatus, as set forth in claim 8, including a second support element, said first and second support elements movably connected to the respective first and second chains.

10. An apparatus, as set forth in claim 9, wherein the means for releasably connecting said first and second cutting elements is connected to said first and second support elements.

11. An apparatus, as set forth in claim 8, wherein at least one of said chains is a driven chain.

* * * * *